US012637736B2

(12) United States Patent
Kim et al.

(10) Patent No.: US 12,637,736 B2
(45) **Date of Patent: *May 26, 2026**

(54) HYDROMETALLURGICAL RECOVERY METHOD FOR NICKEL SULFATE

(71) Applicant: ECOPRO MATERIALS, CO., LTD., Pohang-si (KR)

(72) Inventors: Dong Hee Kim, Pohang-si (KR); Yong Hun Kim, Pohang-si (KR); Woo Jin Kim, Pohang-si (KR)

(73) Assignee: ECOPRO MATERIALS, CO., LTD., Pohang-si (KR)

( * ) Notice: Subject to any disclaimer, the term of this patent is extended or adjusted under 35 U.S.C. 154(b) by 641 days.

This patent is subject to a terminal disclaimer.

(21) Appl. No.: 18/011,279

(22) PCT Filed: Jan. 7, 2022

(86) PCT No.: PCT/KR2022/000310

§ 371 (c)(1),
(2) Date: Dec. 19, 2022

(87) PCT Pub. No.: WO2023/128042

PCT Pub. Date: Jul. 6, 2023

(65) Prior Publication Data

US 2024/0117460 A1 Apr. 11, 2024

(30) Foreign Application Priority Data

Dec. 28, 2021 (KR) ..... 10-2021-0189827

(51) Int. Cl.
*C22B 3/22* (2006.01)
*C22B 3/08* (2006.01)
*C22B 3/44* (2006.01)

(52) U.S. Cl.
CPC ..... *C22B 3/22* (2013.01); *C22B 3/08* (2013.01); *C22B 3/44* (2013.01)

(58) Field of Classification Search
CPC .... C22B 3/22; C22B 3/08; C22B 3/44; C01G 53/11
See application file for complete search history.

(56) References Cited

U.S. PATENT DOCUMENTS 10,995,014 B1 * 5/2021 Fraser ..... C22B 3/1633
2023/0313337 A1 * 10/2023 Miyazaki ..... C22B 23/005 75/743

FOREIGN PATENT DOCUMENTS

CN 112375910 A * 2/2021 ..... C22B 19/20
JP 2012-031446 A 2/2012
(Continued)

OTHER PUBLICATIONS

English machine translation of CN-112375910-A (Year: 2019).*
(Continued)

*Primary Examiner* — Richard M Rump
(74) *Attorney, Agent, or Firm* — Bridgeway IP Law Group, PLLC; Jihun Kim

(57) ABSTRACT

The present disclosure relates to a hydrometallurgical recovery method for nickel sulfate. More specifically, the present disclosure relates to a hydrometallurgical nickel sulfate recovery method in which a wet smelting process is used to extract a high-purity nickel sulfate aqueous solution from a raw material containing nickel (Ni), cobalt (Co), and manganese (Mn). In the method, sodium hydroxide or sodium carbonate is not used as a neutralizer but nickel hydroxide is used, which prevents salts of impurities from being generated as a precipitate in a solvent extraction process, thereby increasing process efficiency of the solvent extraction process.

5 Claims, 2 Drawing Sheets

(56) References Cited

FOREIGN PATENT DOCUMENTS

| | | | |
|---|---|---|---|
| KR | 10-1861885 | B1 | 5/2018 |
| KR | 10-1949042 | B1 | 2/2019 |
| KR | 10-2020-0098949 | A | 8/2020 |
| KR | 10-2020-0138238 | A | 12/2020 |

OTHER PUBLICATIONS

Yue, Tong, et al. "Low-pH mediated goethite precipitation and nickel loss in nickel hydrometallurgy." Hydrometallurgy 165 (2016): 238-243.*

Yang, Gordon CC, Yu-Chen Huang, and Sheng-Chih Huang. "Recovery of valuable metals from cylindrical 18650-type spent lithium-ion batteries." (2017).*

Granata, Giuseppe, et al. "Product recovery from Li-ion battery wastes coming from an industrial pre-treatment plant: Lab scale tests and process simulations." Journal of Power Sources 206 (2012): 393-401.*

Pritzl, Daniel, et al. "Washing of nickel-rich cathode materials for lithium-ion batteries: towards a mechanistic understanding." Journal of the Electrochemical Society 166.16 (2019): A4056-A4066.*

* cited by examiner

| | raw material | after Pre-washing | after Pulping | after leaching | after removing impurities |
|---|---|---|---|---|---|
| Ni | 100 | 101.4 | 101.4 | 101.4 | 108.1 |
| Co | 100 | 105.5 | 105.5 | 105.5 | 109.8 |
| Fe | 100 | 100.0 | 100.0 | 100.0 | 1.0 |
| Mn | 100 | 100.1 | 100.1 | 100.1 | 99.6 |
| Mg | 100 | 57.2 | 57.2 | 57.2 | 57.7 |
| Ca | 100 | 51.0 | 51.0 | 51.0 | 22.9 |
| Al | 100 | 100.0 | 100.0 | 100.0 | 5.0 |
| Na | 100 | 38.2 | 38.4 | 38.4 | 41.1 |

HYDROMETALLURGICAL RECOVERY METHOD FOR NICKEL SULFATE

TECHNICAL FIELD

The present disclosure relates to a recovery method for nickel sulfate through hydrometallurgy. More particularly, the present disclosure relates to a hydrometallurgical recovery method for nickel sulfate, the method employing a wet smelting process by which an aqueous solution of high-purity nickel sulfate can be extracted from a raw material bearing (Ni), cobalt (Co), and manganese (Mn).

BACKGROUND ART

Nickel sulfate has been used primarily to manufacture magnetic storage media, PCB substrates, electrodes, and current collectors of various electronic devices through electroplating or electroless electroplating to manufacture general industrial parts or decorative components through electroplating or electroless electroplating, and has recently received great attention as a key fundamental ingredient in the manufacturing of positive electrode materials for lithium secondary batteries.

Nickel sulfate is typically a hexahydrate crystal. To use the nickel sulfate for the purposes described above, it is known that the nickel sulfate needs to have a nickel sulfate content of 99% or more, an impurity content (i.e., total content of components other than nickel) of several hundred ppm or less, and a crystal size of several millimeters. Nickel sulfate can be produced by hydrometallurgy of various raw materials such as nickel metal (in bulks, brackets, granules, powders, etc.), nickel mattes, nickel concentrates, and by-product sludge generated from metal smelting and refining processes.

To prepare such nickel sulfate hexahydrate, the following method has been conventionally used: first, sodium hydroxide or sodium carbonate as a neutralizer was added to a nickel-bearing aqueous solution to raise the pH of the solution so that nickel hydroxide or nickel carbonate was obtained as a precipitate; secondly, the precipitate was collected through filtration and washing; thirdly, the collected precipitate was dissolved with sulfuric acid to obtain an aqueous solution of nickel sulfate; and finally, the solution undergoes a crystallization process to produce nickel sulfate hexahydrate.

However, such a conventional method had a problem that Na ions that were generated by the addition of the neutralizer could not be removed in a nickel aqueous solution state. Therefore, to remove Na ions, a method of filtering and washing sludge in a filter press has been used. However, this method has the disadvantages of increasing the amount of liquid waste and taking a long time for the processing. Therefore, the method causes a big problem in terms of production yields and liquid waste treatment costs.

DISCLOSURE

Technical Problem

The present disclosure has been made in view of the problems occurring in the related art, and an objective of the present disclosure is to provide a hydrometallurgical nickel sulfate recovery method being capable of producing an aqueous solution of high-purity nickel sulfate by performing a wet smelting process using on a raw material containing nickel (Ni), cobalt (Co), and manganese (Mn), and being capable of preventing impurities as salts from precipitating in a solvent extraction process by using nickel hydroxide as a neutralizer rather than using sodium hydroxide or sodium carbonate.

Another objective of the present disclosure is to provide a hydrometallurgical recovery method for nickel sulfate, the method preparing nickel hydroxide to be used in an iron precipitation step from liquid waste generated during reaction processes, thereby minimizing the loss of nickel.

The objectives of the present disclosure are not limited to the ones described above, and other objectives will be clearly understood by those skilled in the art from the following description.

Technical Solution

In order to accomplish the above objectives, the present disclosure provides a hydrometallurgical recovery method for nickel sulfate, the method including: a washing step of washing a raw material containing nickel (Ni), cobalt (Co), and manganese (Mn) with washing water; a first solid-liquid separation step of separating the washed raw material into a raw material cake and a filtrate; a leaching step of adding sulfuric acid to the raw material cake for reaction therebetween; an iron precipitation step of precipitating an iron component by adding hydrogen peroxide and nickel hydroxide ($Ni(OH)_2$) to a leachate formed through the leaching step; a second solid-liquid separation step of separating the resulting reaction products into a precipitate containing iron (Fe) and a leachate containing nickel, cobalt, and manganese; a solvent extraction step of extracting a nickel sulfate aqueous solution ($NiSO_4$) from the leachate; and a nickel hydroxide preparation step of preparing nickel hydroxide ($Ni(OH)_2$) from a nickel-bearing liquid waste obtained through a washing process within the leaching step, in which the nickel hydroxide prepared by the nickel hydroxide preparation step is recycled in the nickel precipitation step.

In a preferred embodiment, the leaching step includes a first leaching step of adding sulfuric acid to the raw material cake for reaction between the sulfuric acid and the raw material cake and a second leaching step of adding hydrogen peroxide to a primary leachate formed through the first leaching step for reaction between the primary leachate and the hydrogen peroxide.

In a preferred embodiment, the raw material may be a mixed hydroxide precipitate (MHP, $Me(OH)_2$), a mixed carbonate precipitate (MCP, $MeCO_3$), a mixed sulfate precipitate (MSP, $MeSO_4$), or black powder (BP), in which Me represents Ni, Co, or Mn.

In a preferred embodiment, in the washing step, the volume ratio of the raw material to the washing water is a range of 1:1 to 5.

In a preferred embodiment, the equivalent ratio of the metal of the raw material cake to the sulfuric acid in the leaching step may be in a range of 1:0.5 to 2.

In a preferred embodiment, in the second leaching step, the equivalent ratio of the metal components including manganese and cobalt to the hydrogen peroxide in the primary leachate may be in a range of 1:0.5 to 2.

In a preferred embodiment, in the washing step, the volume ratio of the raw material to the washing water may be in a range of 1:1 to 3.

In a preferred embodiment, the iron precipitation may be performed at a pH in a range of 3.5 to 6.5.

In a preferred embodiment, the nickel hydroxide preparation step may include: a nickel hydroxide precipitation step in which sodium hydroxide (NaOH) is added to the liquid waste to precipitate nickel hydroxide contained in the liquid waste; a third solid-liquid separation step in which the reaction products of the nickel hydroxide precipitation step are separated into a nickel hydroxide precipitate and a filtrate; and a washing step in which the nickel hydroxide precipitate is washed with water so that residual sodium is removed.

In a preferred embodiment, the solvent extraction step includes a first solvent extraction step of separating manganese from the leachate; and a second solvent extraction step of separating cobalt from the leachate from which manganese is removed to obtain a nickel sulfate solution ($NiSO_4$).

Advantageous Effects

The present invention has the advantages described below.

With the use of the hydrometallurgical nickel sulfate recovery method of the present disclosure, an aqueous solution of high-purity nickel sulfate can be produced in a mass production volume from a raw material bearing (Ni), cobalt (Co), and manganese (Mn) by using a wet smelting process.

In addition, with the use of the hydrometallurgical nickel sulfate recovery method of the present disclosure, nickel hydroxide used in the iron precipitation step is prepared from liquid waste generated in reaction processes. Therefore, it is possible to minimize the loss of nickel discarded as contained in the effluent. In addition, since sodium hydroxide or sodium carbonate is not used as a neutralizer, it is possible to prevent the precipitation of salts of impurities during the solvent extraction step, thereby increasing the process efficiency of the solvent extraction step.

BEST MODE

Figure 1:
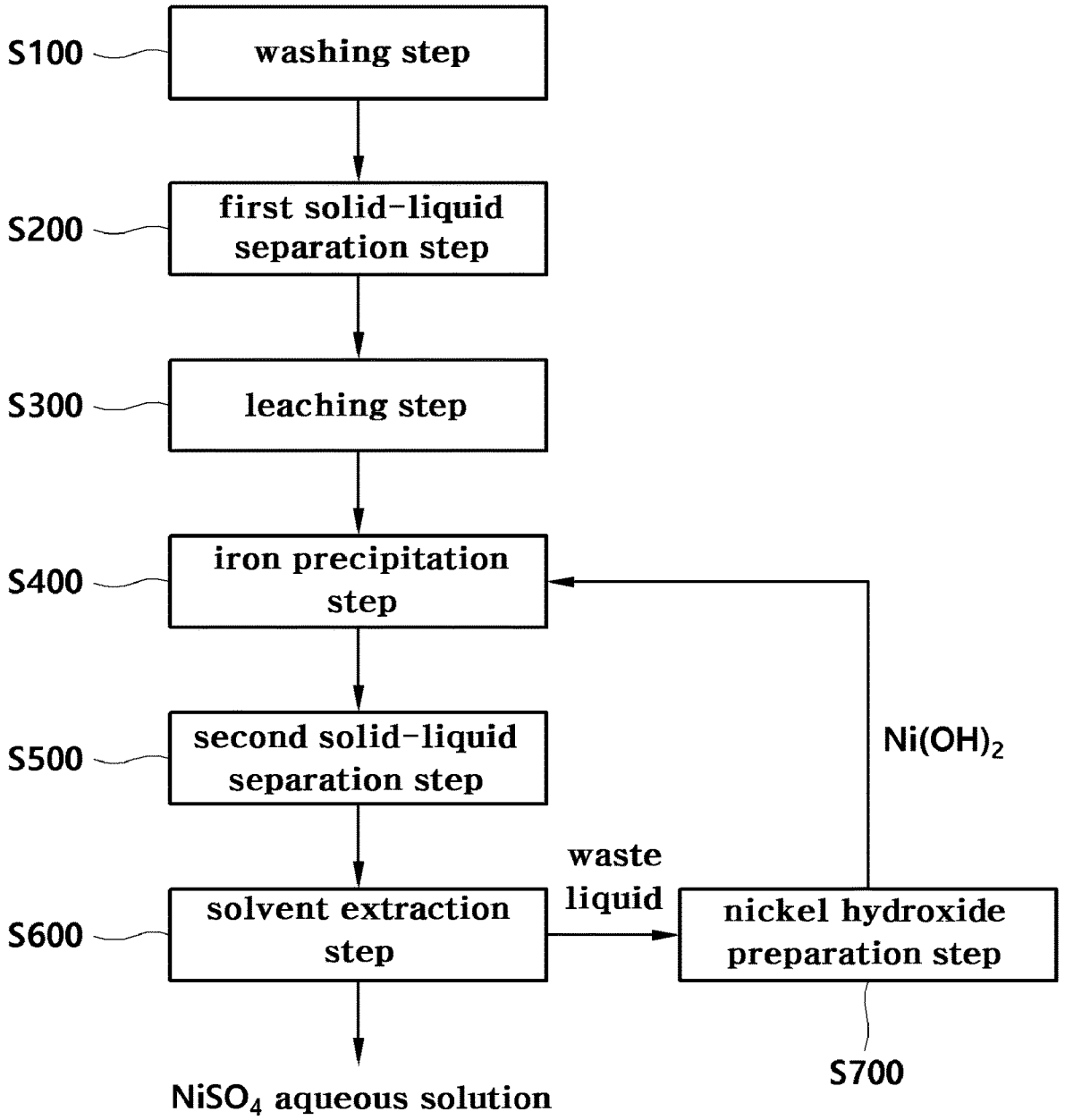
FIG. 1 is a diagram illustrating a hydrometallurgical nickel sulfate recovery method according to the present disclosure.

As the terms used to describe the present disclosure in the present disclosure, as many general terms as possible are selected. However, in certain cases, terms that are chosen by the inventors of the present disclosure may be used. In such cases, the meanings of the terms should be understood not simply by the name but by the detailed description of the invention.

Hereinafter, the technical aspects of the present disclosure will be described in detail with reference to the preferred embodiments illustrated in the accompanying drawings.

However, the present invention is not limited to the embodiments described herein and may be embodied in other forms. Like reference numerals refer to like elements throughout the description herein and the drawings.

[FIG. 1 is a diagram illustrating a hydrometallurgical nickel sulfate recovery method according to one embodiment of the present disclosure.

Referring to FIG. 1, according to one embodiment of the present disclosure, a hydrometallurgical nickel sulfate recovery method is a method of producing a high-purity nickel sulfate aqueous solution from a raw material containing nickel (Ni), cobalt (Co), and manganese (Mn) by using a wet smelting process. First, a washing step S100 is performed in which the raw material is prewashed with washing water.

The raw material is not particularly limited if it contains nickel (Ni), cobalt (Co), and manganese (Mn). For example, the raw material may be mixed a hydroxide precipitate (MHP, $Me(OH)_2$), a mixed carbonate precipitate (MCP, $MeCO_3$), a mixed sulfate precipitate (MSP, $MeSO_4$), a mixed sulfide precipitate (MSP, MeS), or a black powder (BP). Here, Me is Ni, Co, or Mn.

In the washing step S100, the volumetric ratio of the raw material to the washing water is preferably in a range of 1:1 to 5. In this step, impurities such as Ca, Mg, Al, Na, Li, and the like contained in the raw material are removed. In particular, Na is removed to be a concentration of 200 ppm or less.

Next, the raw material washed through the washing step S100 is separated into a raw material cake and a filtrate in a first solid-liquid separation step S200.

In the first solid-liquid separation step S200, water may be added, and impurities remaining on the surface of the raw material cake may be removed after filtration.

Next, a leaching step S300 is performed in which sulfuric acid is added for reaction to the raw material cake obtained through the first solid-liquid separation step S200.

In the leaching step S300, the equivalent ratio of metals such as Ni, Co, Mn, Cu, Fe, and Al to the sulfuric acid in the raw material cake is preferably in a range of 1:0.5 to 2.

The leaching step S300 may include a first leaching step S310 and a second leaching step S320.

The first leaching step S310 is a pulping process of partially dissolving the raw material by adding sulfuric acid to the raw material cake.

In the first leaching step S310, about 65% of the total sulfuric acid used in the leaching step S300 is used. Reactivity control is performed to inhibit the generation of sulfur gas and to control the exothermic reaction.

The second leaching step S320 is performed to completely dissolve a primary leachate generated in the first leaching step S310 by adding hydrogen peroxide to the primary leachate.

Preferably, the equivalent ratio of the metal components including manganese and cobalt in the primary leachate to the hydrogen peroxide is in a range of 1:0.5 to 2. In this step, the hydrogen peroxide reduces insoluble components including $Mn^{4+}$ and $Co^{3+}$ so that the insoluble components can be dissolved.

In the second leaching step S320, about 35% of the total amount of sulfuric acid used in the leaching step S300 is used.

Next, an iron precipitation step S400 is performed in which hydrogen peroxide and nickel hydroxide ($Ni(OH)_2$) are added to the leachate formed through the leaching step S300 for iron precipitation In the iron precipitation step S400, the equivalent ratio of the iron in the leachate to the hydrogen peroxide is in a range of 1:0.5 to 3, and the hydrogen peroxide oxidizes the impurity Fe to trivalent iron (ferric), thereby inducing precipitation of geothite (FeOOH).

In addition, in the iron precipitation step S400, the nickel hydroxide raises the pH to a range of 3.5 to 6.5, thereby precipitating impurities including Fe and Al.

On the other hand, the nickel hydroxide used in this step may be nickel hydroxide produced by recycling liquid waste generated in a solvent extraction step S600 described below. A detailed description of the production of the nickel hydroxide may be given below.

Next, a second solid-liquid separation step S500 is performed in which the reaction products formed through the iron precipitation step S400 are separated into a precipitate containing iron and a leachate containing nickel, cobalt, and manganese.

Next, a solvent extraction step S600 is performed in which a nickel sulfate aqueous solution ($NiSO_4$) is extracted from the leachate produced through the second solid-liquid separation step S500.

The solvent extraction step S600 may be a two-stage solvent extraction step including a first solvent extraction step S610 and a second solvent extraction step S620.

The first solvent extraction step 610 is a solvent extraction process of removing manganese from the leachate. The first solvent extraction step 610 involves extraction, washing, and reverse extraction that are performed in this order. In this step, a phosphoric extractant may be used.

In addition, the second solvent extraction step S620 is a solvent extraction process of extracting a nickel sulfate aqueous solution ($NiSO_4$) by separating cobalt from the leachate from which manganese first removed. This solvent extraction process involves extraction, washing, and reverse extraction which are performed in this order. In this step, a phosphinic extractant is used.

Next, a nickel hydroxide preparation step S700 is performed in which nickel hydroxide ($Ni(OH)_2$) is prepared from the nickel-bearing liquid waste obtained through the solvent extraction step.

More specifically, the nickel hydroxide preparation step S700 may be divided into a nickel hydroxide precipitation step S710, a third solid-liquid separation step S720, and a washing step S730 which are performed in this order.

Here, in the nickel hydroxide precipitation step S710, 10% sodium hydroxide (NaOH) is added to complete the precipitation of nickel contained in the liquid waste, and the pH is adjusted to a range of 7.0 to 9.0, so that nickel hydroxide is precipitated in the liquid waste.

Next, the third solid-liquid separation step S720 is performed to separate the reaction products generated in the nickel hydroxide precipitation step S710 into a nickel hydroxide precipitate and a filtrate.

The nickel hydroxide precipitate obtained by the separation is then washed with water to remove residual sodium, and the washing step S730 of obtaining nickel hydroxide is performed.

The nickel hydroxide ($Ni(OH)_2$) prepared in the nickel hydroxide preparation step S700 as described above will be used in the iron precipitation step S400.

In The hydrometallurgical nickel sulfate recovery method according to the present disclosure, the liquid waste generated in the solvent extraction step S600 is recycled to produce nickel hydroxide, and the nickel hydroxide is used as a neutralizer in the iron precipitation step S400. Therefore, it is possible to minimize the loss of nickel discarded as contained in the effluent. In addition, sodium hydroxide or sodium carbonate is not used as a neutralizer, it is possible to prevent impurities from being precipitated as salts in the solvent extraction step, thereby improving the process efficiency of the solvent extraction step.

EXAMPLE

Example 1 (Washing and First Solid-Liquid Separation Step)

100 parts by weight of a raw material (Ni-MHP) containing nickel (Ni), cobalt (Co), and manganese (Mn) was washed with 100 parts by weight of washing water, followed by washing and solid-liquid separation to obtain a solid phase that is washed.

Here, the composition of the raw material, which was a mixed hydroxide precipitate (MHP, $Me(OH)_2$), is shown in Table 1 (where Me is Ni, Co, or Mn).

TABLE 1

| Raw material | Composition (%) |
|---|---|
| Ni | 35 to 40 |
| Co | 1 to 5 |
| Mn | 1 to 5 |
| Cu | 0.1 to 0.2 |
| Zn | 0.1 to 0.5 |
| Ca | 0.1 to 0.3 |
| Mg | 1 to 3 |
| Fe | 0.1 to 0.5 |
| Al | 0.1 to 0.5 |
| Na | 0.1 to 0.5 |
| Water content | 50 to 55 |

Example 2 (First Leaching Step)

160 parts by weight of water and 30 parts by weight of 98% sulfuric acid were added to 100 parts by weight of the washed solid phase obtained through Example 1 so that reaction occurred. In this case, the equivalent ratio of metals including Ni, Co, Mn, Cu, Fe, and Al contained in the washed solid phase to the sulfuric acid was 1:1.1.

Example 3 (Second Leaching Step)

15 parts by weight of 98% sulfuric acid and 3 parts by weight of 32% hydrogen peroxide were added to 290 parts by weight of the primary leachate obtained through Example 2 so that reaction occurred.

Example 4 (Iron Precipitation Step)

1.5 parts by weight of 32% hydrogen peroxide and 13 parts by weight of nickel hydroxide ($Ni(OH)_2$) were added to 300 parts by weight of the secondary leachate obtained through Example 3 so that reaction to precipitate iron components occurred.

Example 5 (Second Solid-Liquid Separation Step)

The reaction products obtained through Example 4 were separated into a precipitate containing iron and a leachate containing nickel, cobalt and manganese.

Example 6 (Solvent Extraction Step)

320 parts by weight of the leachate containing nickel, cobalt, and manganese, obtained through Example 5, was subjected to two-stage solvent extraction in which phosphoric and phosphinic extractants were used. Thus, liquid waste containing nickel (Ni) and a nickel sulfate aqueous solution ($NiSO_4$) were obtained.

Example 7 (Nickel Hydroxide Preparation Step)

35 parts by weight of 10% NaOH was added to 200 parts by weight of the liquid waste containing nickel (Ni) obtained through Example 6, and the pH was adjusted to 8.0 to allow precipitation of nickel hydroxide contained in the liquid waste. The resulting nickel hydroxide precipitate was then separated and washed with 8.5 parts by weight of washing water to remove residual sodium, resulting in nickel hydroxide ($Ni(OH)_2$). The nickel hydroxide ($Ni(OH)_2$) was used as a neutralizer in an iron precipitation step.

Experimental Example 1

Figure 2:
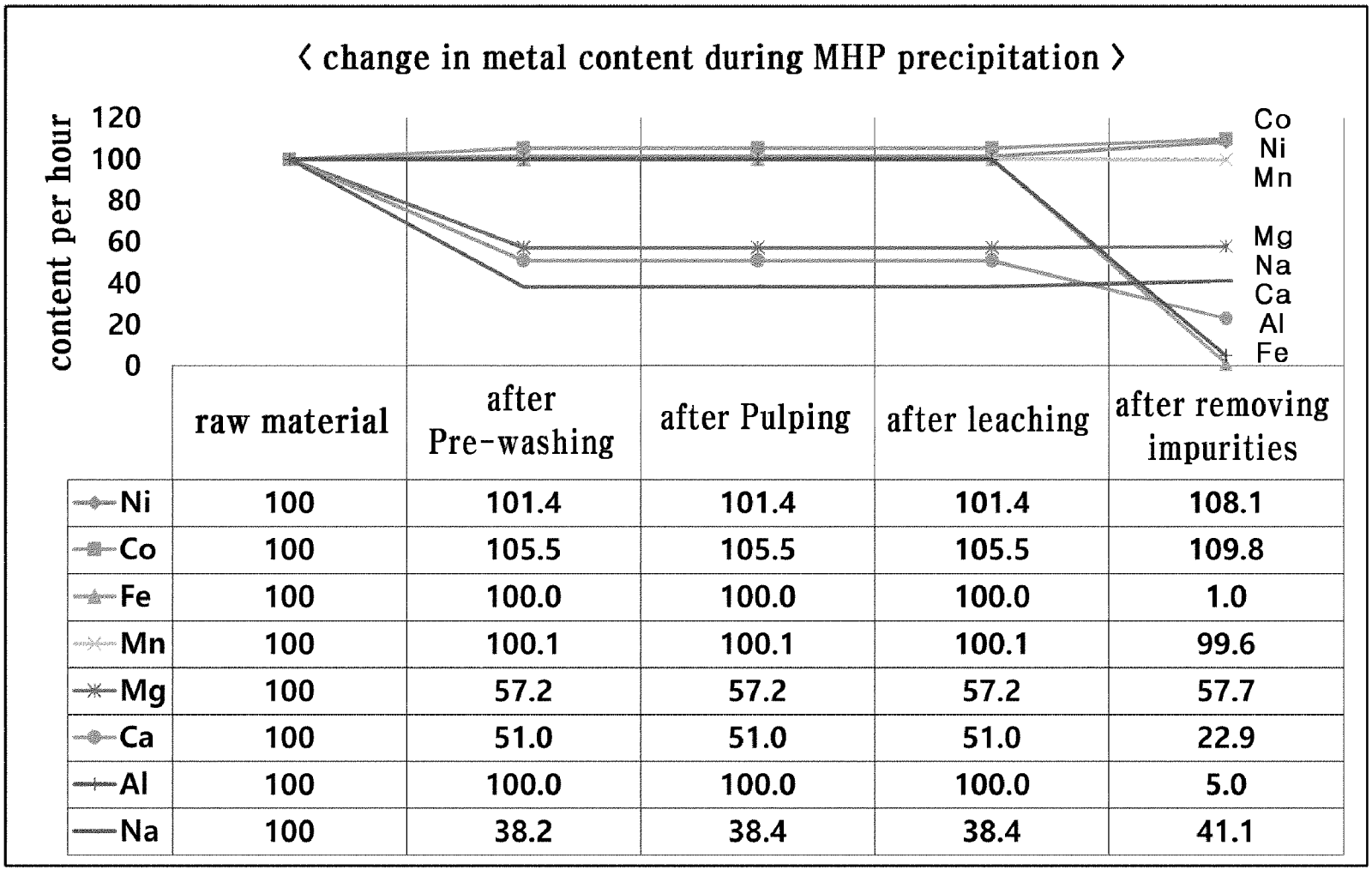
FIG. 2 is a graph illustrating changes in metal content by process steps of a hydrometallurgical nickel sulfate recovery method according to the present disclosure.

Changes in ions of metal components were measured step by step in a hydrometallurgical nickel sulfate recovery method according to the present disclosure, and the results are shown in FIG. 2.

In FIG. 2, the ions of metal components contained in the raw material were determined to be 100 parts by weight, and the change in the components was determined in each major process. The numerical value as a dose per hour refers to the metal content per unit time during continuous process operation.

As illustrated in FIG. 2, it was confirmed that Mg, Ca, and Na are partially removed in the washing step. The increase in Ni and Co components was because the moisture content of the raw material cake obtained through the first solid-liquid separation step was lower than the moisture content of the raw material.

In addition, it was confirmed that there was no loss of each component in the leaching step, and the components were confirmed to be fully leached through the first leaching step and the second leaching step.

It was also confirmed that Fe, Al, and a portion of Ca were removed through the iron precipitation step. In the step, impurities were removed, and thus the contents of Ni and Co per unit time were increased.

Experimental Example 2

The composition of the nickel sulfate aqueous solution ($NiSO_4$) obtained through the hydrometallurgical nickel sulfate recovery method according to the present disclosure was determined, and the results are shown in Table 2 below.

TABLE 2

| Composition of leachate | g/L |
|---|---|
| Ni | 100 to 110 |
| Co | 0 |
| Cu | 0 |
| Fe | 0 |
| Zn | 0 |
| Mn | 0 |
| Mg | 0.001 |
| Ca | 0 |
| Al | 0 |
| Na | 0.1 to 0.3 |

As shown in Table 2, the Ni concentration which was 80 g/L in the leachate obtained through the leaching step was increased to 100 g/L or above, and impurities that are components other than Ni were almost removed. That is, it was confirmed that a high-purity nickel sulfate aqueous solution ($NiSO_4$) was prepared. As described above, with the use of the hydrometallurgical nickel sulfate recovery method according to the present disclosure, it is possible to produce a high-purity nickel sulfate aqueous solution in a mass production volume from a raw material containing nickel (Ni), cobalt (Co), and manganese (Mn) by using a wet smelting process. In addition, since nickel hydroxide used in an iron precipitation step is prepared from liquid waste generated during reaction processes, it is possible to minimize the loss of nickel components as contained in the effluent. In addition, since sodium hydroxide or sodium carbonate is not used as a neutralizer, it is possible to increase the process efficiency of a solvent extraction step by preventing impurities from precipitating as salts in the solvent extraction step.

Although the present invention has been described with reference to the preferred example, the ordinarily skilled in the art will appreciate that the present invention is not limited to the example described above and can be diversely changed and modified without departing from the scope of the spirit of the present invention.

INDUSTRIAL APPLICABILITY

The nickel sulfate recovered by the method of the present disclosure can be used as a fundamental ingredient in manufacturing a positive electrode material of a lithium secondary battery. The recovered nickel sulfate also can be used in electroplating or electroless electroplating for manufacturing magnetic storage media, PCB substrates, electrodes, and current collectors of various electronic components, and in electroplating or electroless electroplating for manufacturing general industrial parts or decorative components.

The invention claimed is:

1. A hydrometallurgical nickel sulfate recovery method comprising:

a washing step of washing a raw material containing nickel (Ni), cobalt (Co), and manganese (Mn) with washing water, wherein the raw material and the washing water are in a volume ratio in a range of 1:1 to 5 in the washing step;

a first solid-liquid separation step of separating the washed raw material into a raw material cake and a filtrate;

a first leaching step of adding sulfuric acid to the raw material cake for reaction, wherein in the first leaching step, an equivalent ratio of a metal in the raw material cake and the sulfuric acid is in a range of 1:0.5 to 2;

a second leaching step of adding hydrogen peroxide to a first leachate obtained through the first leaching step for reaction, wherein in the second leaching step, an equivalent ratio of metal components, including manganese and cobalt, in the first leachate to the hydrogen peroxide is in a range of 1:0.5 to 2;

an iron precipitation step of adding hydrogen peroxide and nickel hydroxide ($Ni(OH)_2$) to a leachate formed through the first and second leaching steps for iron precipitation, wherein in the iron precipitation step, an equivalent ratio of iron in the leachate to the hydrogen peroxide is in a range of 1:0.5 to 3;

a second solid-liquid separation step of separating reaction products of the iron precipitation step into a precipitate containing iron and a leachate containing nickel, cobalt, and manganese;

a solvent extraction step of extracting a nickel sulfate aqueous solution ($NiSO_4$) from the leachate; and a nickel hydroxide preparation step of preparing nickel hydroxide ($Ni(OH)_2$) from nickel-bearing liquid waste obtained through the solvent extraction step, wherein the nickel hydroxide prepared through the nickel hydroxide preparation step is used in the iron precipitation step.

2. The method of claim 1, wherein the raw material is a mixed hydroxide precipitate ($MHP(OH)_2$), a mixed carbonate precipitate (MCP, $MeCO_3$), a mixed sulfate precipitate (MSP, $MeSO_4$), or black powder (BP), and Me is at least one of the Ni, the Co, or the Mn.

3. The method of claim 1, wherein in the iron precipitation, reaction is performed at a pH in a range of 3.5 to 6.5.

4. The method of claim 1, wherein the nickel hydroxide preparation step comprises:

a nickel hydroxide precipitation step of adding sodium hydroxide (NaOH) to the nickel-bearing liquid waste to precipitate the nickel hydroxide contained in the nickel-bearing liquid waste;

a third solid-liquid separation step of separating the reaction products generated in the nickel hydroxide precipitation step into a nickel hydroxide precipitate and the filtrate; and a washing step of washing the nickel hydroxide precipitate with water to remove residual sodium.

5. The method of claim 1, wherein the solvent extraction step comprises:

a first solvent extraction step of separating manganese from the leachate; and a second solvent extraction step of extracting the nickel sulfate aqueous solution ($NiSO_4$) by separating cobalt from the leachate from which the manganese is removed.

* * * * *